US009320935B1

(12) United States Patent
Paris

(10) Patent No.: US 9,320,935 B1
(45) Date of Patent: Apr. 26, 2016

(54) EXERCISE DEVICE

(71) Applicant: Adaptive Therapies LLC, Raleigh, NC (US)

(72) Inventor: Gary R Paris, Raleigh, NC (US)

(73) Assignee: Upper Body Fitness LLC, Raleigh, NC (US)

( * ) Notice: Subject to any disclaimer, the term of this patent is extended or adjusted under 35 U.S.C. 154(b) by 0 days.

(21) Appl. No.: 14/923,842

(22) Filed: Oct. 27, 2015

Related U.S. Application Data

(63) Continuation-in-part of application No. 13/623,154, filed on Sep. 20, 2012.

(51) Int. Cl.
*A63B 71/00* (2006.01)
*A63B 21/015* (2006.01)

(52) U.S. Cl.
CPC ..... *A63B 21/015* (2013.01); *A63B 21/4033* (2015.10); *A63B 21/4035* (2015.10)

(58) Field of Classification Search
CPC ..... A63B 21/4033; A63B 21/4034; A63B 21/4035; A63B 21/4049; A63B 22/0002; A63B 22/0035; A63B 22/0046; A63B 22/0605; A63B 23/12; A63B 23/1245; A63B 23/14; A63B 23/16; A63B 2022/0041; A63B 2022/0617; A63B 2022/0652; A61H 1/0214; A61H 1/0274; A61H 1/0281; A61H 1/0285
See application file for complete search history.

(56) References Cited

U.S. PATENT DOCUMENTS

| | | | | |
|---|---|---|---|---|
| 2,668,709 | A * | 2/1954 | Boyko | A63B 22/0007 482/60 |
| 5,569,128 | A * | 10/1996 | Dalebout | A63B 22/0005 482/57 |
| 5,683,330 | A * | 11/1997 | Kobayashi | A63B 22/0605 482/51 |
| 6,036,623 | A * | 3/2000 | Mitchell | A63B 23/03575 482/57 |
| 6,036,624 | A * | 3/2000 | Cascini | A63B 21/154 482/130 |
| 7,625,318 | B1 * | 12/2009 | Heyn | A63B 21/4013 482/100 |
| 9,044,630 | B1 * | 6/2015 | Lampert | A63B 23/035 |
| 2002/0177510 | A1 * | 11/2002 | Schneider | A63B 22/0002 482/92 |
| 2004/0259693 | A1 * | 12/2004 | Chien | A61H 1/0214 482/62 |
| 2007/0281836 | A1 * | 12/2007 | Gearon | A63B 22/0007 482/62 |
| 2008/0085819 | A1 * | 4/2008 | Yang | A63B 21/015 482/62 |
| 2009/0227430 | A1 * | 9/2009 | Kashiwaya | A63B 23/1254 482/94 |
| 2014/0081186 | A1 * | 3/2014 | Paris | A63B 22/0002 601/33 |

* cited by examiner

*Primary Examiner* — Oren Ginsberg
*Assistant Examiner* — Gregory Winter
(74) *Attorney, Agent, or Firm* — NK Patent Law, PLLC

(57) ABSTRACT

An exercise device includes a seat, a first support member pivoting from a first pivot point about the seat, and a first resistance wheel having a handle extending therefrom, the wheel being attached on a terminal end of a slider to a mount carrying the first resistance wheel and having a first plate and second plate through which a pin extends thereinto in order to rotate the resistance wheel relative to the slider. The first support member is pivotable from the first pivot point in order to place the resistance wheel in a plurality of discrete positions relative to the seat including one position in which the resistance wheel is locked in position and aligned with a longitudinally extending centerline of the seat.

19 Claims, 6 Drawing Sheets

EXERCISE DEVICE

CROSS-REFERENCE TO RELATED APPLICATIONS

This application is a continuation-in-part of U.S. patent application Ser. No. 13/623,154 filed on Sep. 20, 2012, the entire contents of which are incorporated by reference herein.

TECHNICAL FIELD

The presently disclosed subject matter is directed towards an exercise device.

BACKGROUND

The use of exercise devices such as weight training and cardiovascular training machines include a repeated movement that moves over a designated path. For weight training there is a resistance provided by weights, bands, or the like to render the movement more difficult and intensify the exercise. With cardio type or shoulder rehabilitation type exercise, frequently handles are grasped and rotated in a circular fashion much like pedals on the bike either by hand or foot. The movement itself dictates the muscles or muscle groups involved in the exercise.

One great problem with exercise equipment in general is that handles, foot loops, or the like are usually fixed such that parallel back and forth or parallel circular motions are achieved. This is usually also done in a perpendicular to the user's chest fashion with arms spread apart shoulder width. These fixed handles limit the way the muscles are exercised and is not adequate to real life situations since in real life pushing, pulling, and rotation motions can end up in any of the 6 degrees of movements allowed by limbic rotation. For example, an individual may need to push an object with arms spread wide apart, thus using muscles differently than shoulder width apart on most machines. For all around training, current hand driven exercise machines are limited by design to at most those that raise and lower the handles and do not function to completely train and/or rehabilitate the individual. Using both hands on either side of a wheel to rotate the wheel limits the movements of the machine to exercising in a single plane and greatly limits the potential of the machine in both shoulder rehabilitation and upper body development.

Accordingly, there remains a need for a device that addresses the various disadvantages associated with previous devices.

SUMMARY

According to one or more embodiments, an exercise device includes a seat and a first exercise assembly. The first assembly includes a first support member pivoting from a first pivot point about the seat, a first resistance wheel having a handle extending therefrom, the wheel being attached on a terminal end of a first slider to a first mount carrying the first resistance wheel and having a first plate and second plate through which a pin extends thereinto in order to rotate the resistance wheel relative to the first slider. A second exercise assembly includes a second support member pivoting from a second pivot point about the seat and a second resistance wheel having a handle extending therefrom. The wheel is attached on a terminal end of a slider to a second mount carrying the second resistance wheel and having a first plate and second plate through which a pin extends thereinto in order to rotate the resistance wheel relative to the second slider. Each the first support member and the second support member are pivotable from respective first and second pivot points in order to place the respective first and second resistance wheels in a plurality of discrete positions relative to the seat including one position in which the first resistance wheel is locked in position and spaced-apart and extending parallel to a longitudinally extending centerline of the seat and the second resistance wheel is locked in position and spaced-apart and extending parallel to the longitudinally extending centerline such that the first resistance wheel and the second resistance wheel are spaced-apart and extend parallel to one another.

According to one or more embodiments, the first support member defines first and second portions that are angled relative to one another.

According to one or more embodiments, the first support member defines an upright portion extending from the second portion.

According to one or more embodiments, the handle extends offset from a centerline of the resistance wheel.

According to one or more embodiments, the slider is configured to translate the resistance wheel relative to the first support member.

According to one or more embodiments, the slider has a compression pin extending between two spaced-apart cassettes, where the pin locks the slider relative to the first support. In one or more embodiments, a small handle that the user pushes to add compression on the slider and pulls to release pressure on the slider may be employed.

According to one or more embodiments, the slider is carried by the upright portion of the first support member.

According to one or more embodiments, the upright portion is adjustable lengthwise to adjust the height thereof.

According to one or more embodiments, the first plate is rigidly secured to the slider and the second plate is rotatably carried by the slider.

According to one or more embodiments, the second plate has a plurality of circumferentially defined apertures defined therethough to which the pin extends to lock the resistance wheel in a desired position relative to the slider.

According to one or more embodiments, the device includes a weight support biasing member extending from the upright portion to the mount of the slider for biasing lifting of the mount to a desired height position.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Further, the claimed subject matter is not limited to implementations that solve any or all disadvantages noted in any part of this disclosure.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

The presently disclosed subject matter now will be described more fully hereinafter with reference to the accompanying drawings, in which some, but not all embodiments are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 4:
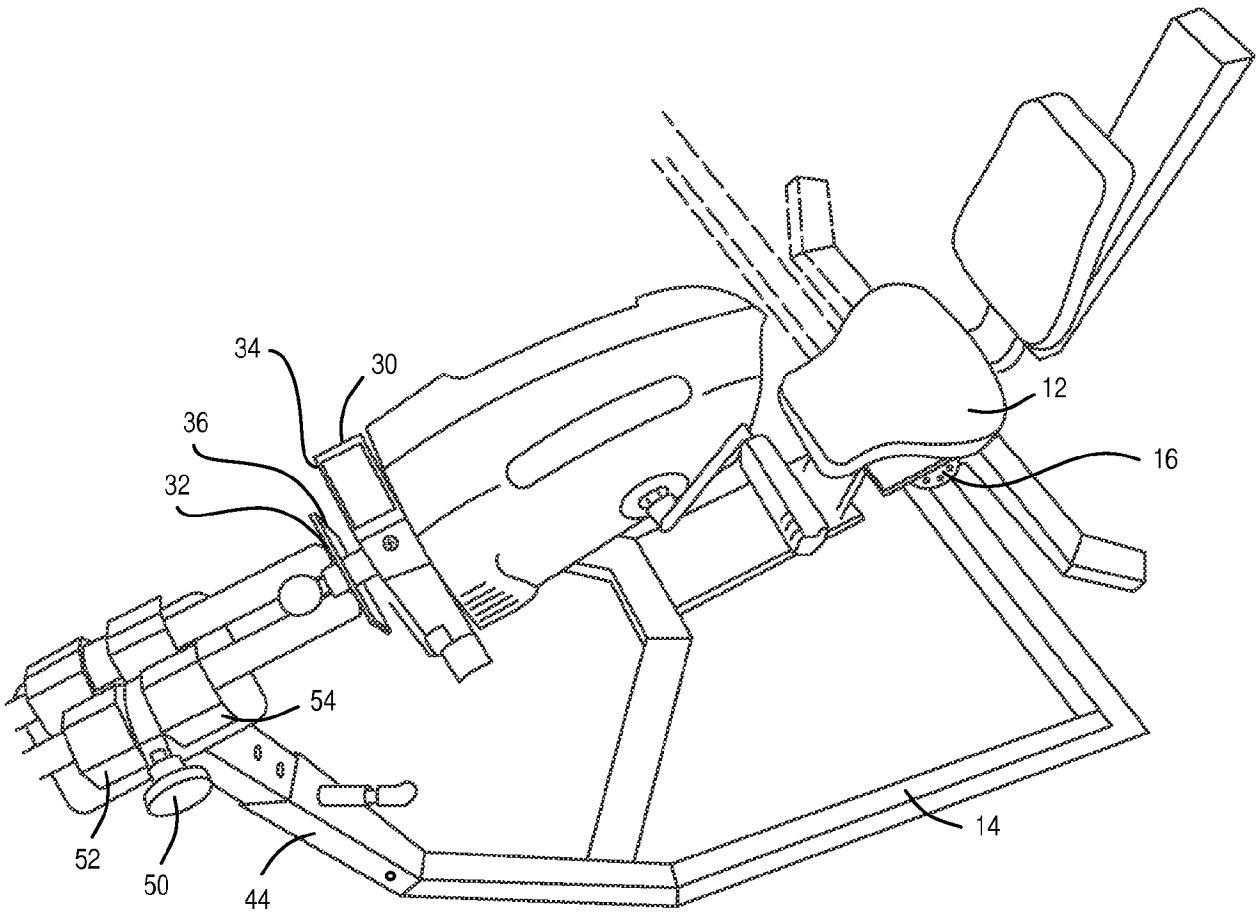
FIG. 4 is a downward facing perspective view of an exercise device according to one or more embodiments.

An exercise device is provided. The device is generally designated 10 and includes a plurality of adjustment mechanisms that allow for adjustment of the exercise mechanisms and assemblies disclosed herein. The device 10 includes a seat 12. The seat 12 may take on any appropriate and aesthetically and ergonomically effective arrangement. The device 10 may further include a first exercise assembly 13, where the first exercise assembly 13 includes a first support member 14 pivoting from a first pivot point P1 about the seat 12. The pivot point is shown below the seat 12, but it may be positioned adjacent to or around the seat 12 in appropriate embodiments. The first support member 14 may define a first portion 40 and a second portion 42 that are angled relative to one another. With further reference to FIG. 4, the first support member 14 defines an upright portion 44 extending from the second portion 42. The upright portion 44 may be adjustable lengthwise to adjust the height thereof. As illustrated, the upright portion 44 includes a male and female portion that is slideably received therein and includes a plurality of receiving apertures on the male portion that receives a pin extending from the female portion to lock the height thereof, but any appropriately configured mechanism providing for locking the height of the upright portion 44 may be provided. Bracket 16 allows for horizontal, rotational, and up and down movement of the seat 12. This allows for offset exercising if desired by a user. In this manner, the seat 12 can be pivoted towards a desired seating angle. A slot may be formed in an upright behind the seat 12 that allows for a slider to be received therein that engages the seat 12 and allows upward and downward movement thereof.

Figure 5:
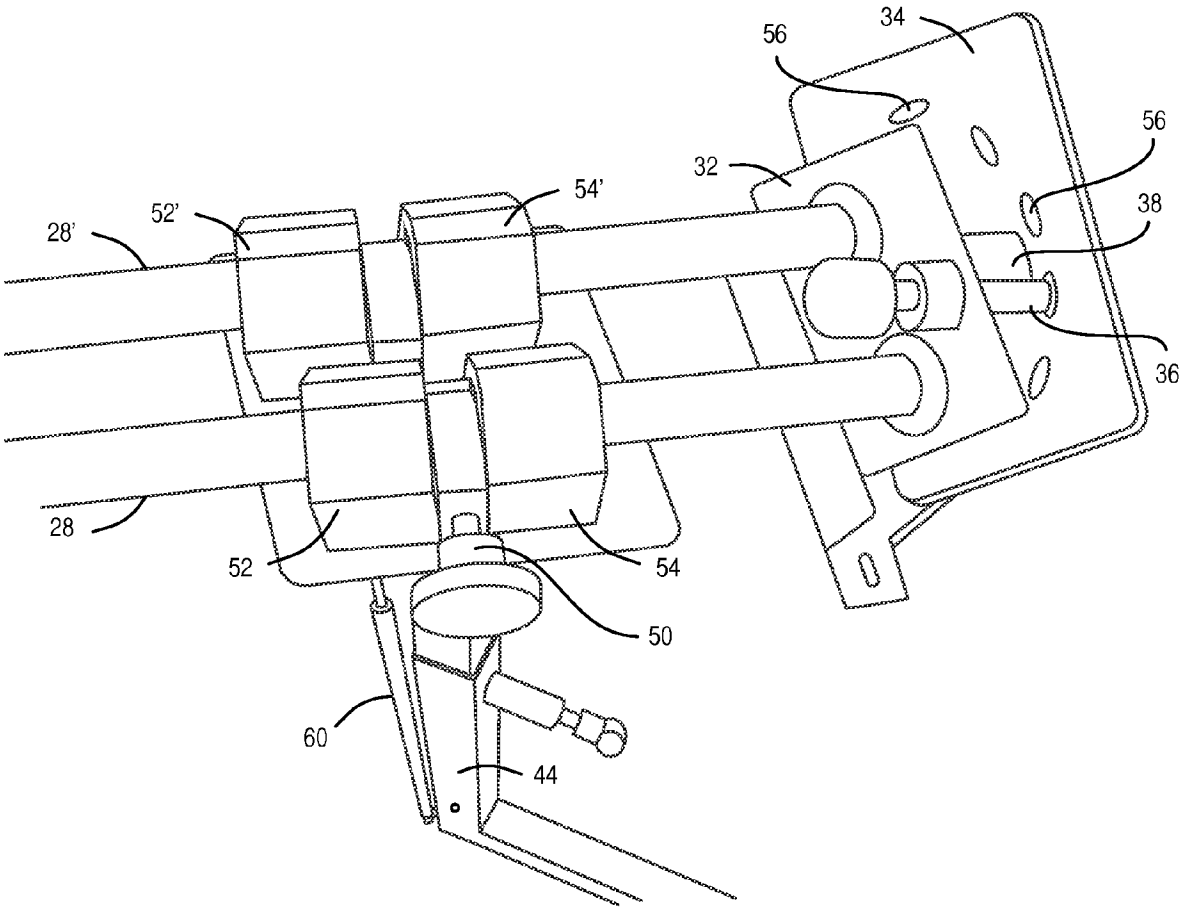
FIG. 5 is a front view of a slider assembly for carrying an exercise assembly disclosed herein according to one or more embodiments.
Figure 6:
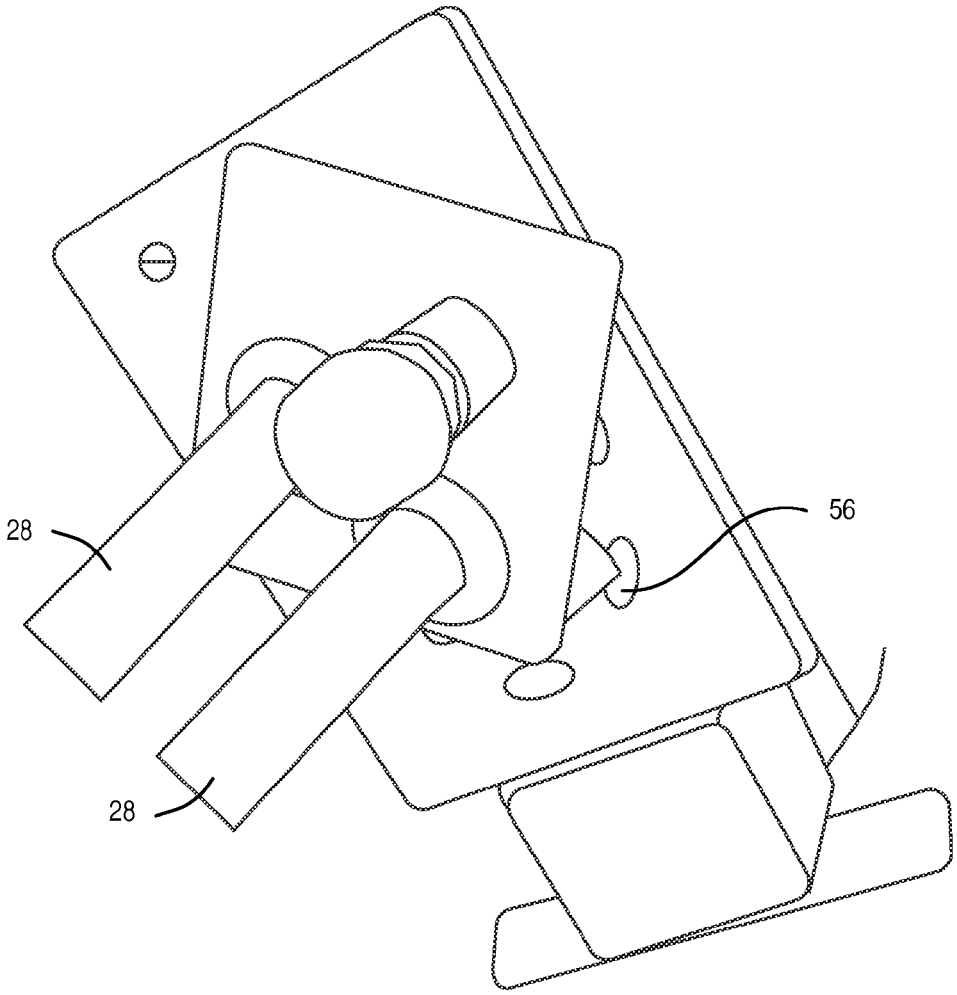
FIG. 6 is a perspective view of an assembly for use with the exercise device disclosed herein.

The first exercise assembly 13 may further include a first resistance wheel 20 having a handle 22 extending therefrom. The handle 22 may extend offset from a centerline of the resistance wheel 20. The resistance wheel 20 is provided for 360 degree rotation and provides aerobic type resistance for exercising the user. The resistance wheel 20 is attached on a terminal end 24 of a first slider 28 to a first mount 30 carrying the first resistance wheel 20 and having a first plate 32 and second plate 34 through which a pin 36 extends thereinto in order to rotate the resistance wheel 20 relative to the first slider 28. The first slider 28 may include a pair of sliders as illustrated in FIG. 4 and FIG. 5. The slider 28 may be configured to translate the resistance wheel 20 in a direction towards and away from the seat 12. As illustrated in one embodiment, the slider 28 has a compression pin 50 extending between two spaced-apart cassettes 52, 54. The pin 50 locks the slider 28 relative to the upright portion 44 of the first support 14. As illustrated, the slider 28 is carried by the upright portion 44 of the first support member 14. In one or more embodiments, the first plate 32 is rigidly secured to the slider 28 and the second plate 34 is rotatably carried by the slider 28. The second plate 34 has a plurality of circumferentially defined apertures 56 defined therethough to which the pin 36 extends to lock the resistance wheel in a desired position relative to the slider. An axle 38 extending between the first plate 32 and the second plate 34 allows for rotation of the second plate 34 relative to the first plate 32. A biasing support member 60 may extend from the upright portion 44 to the mount carrying the slider 28 for providing a biasing support for the weight of the resistance wheel 20 and associated elements.

A second exercise assembly 13' may also be provided. This exercise assembly 13' includes each of the components of exercise assembly 13, with each similarly indicated element being represented by a prime number. For example, the second resistance wheel is indicated as 20'.

Figure 1:
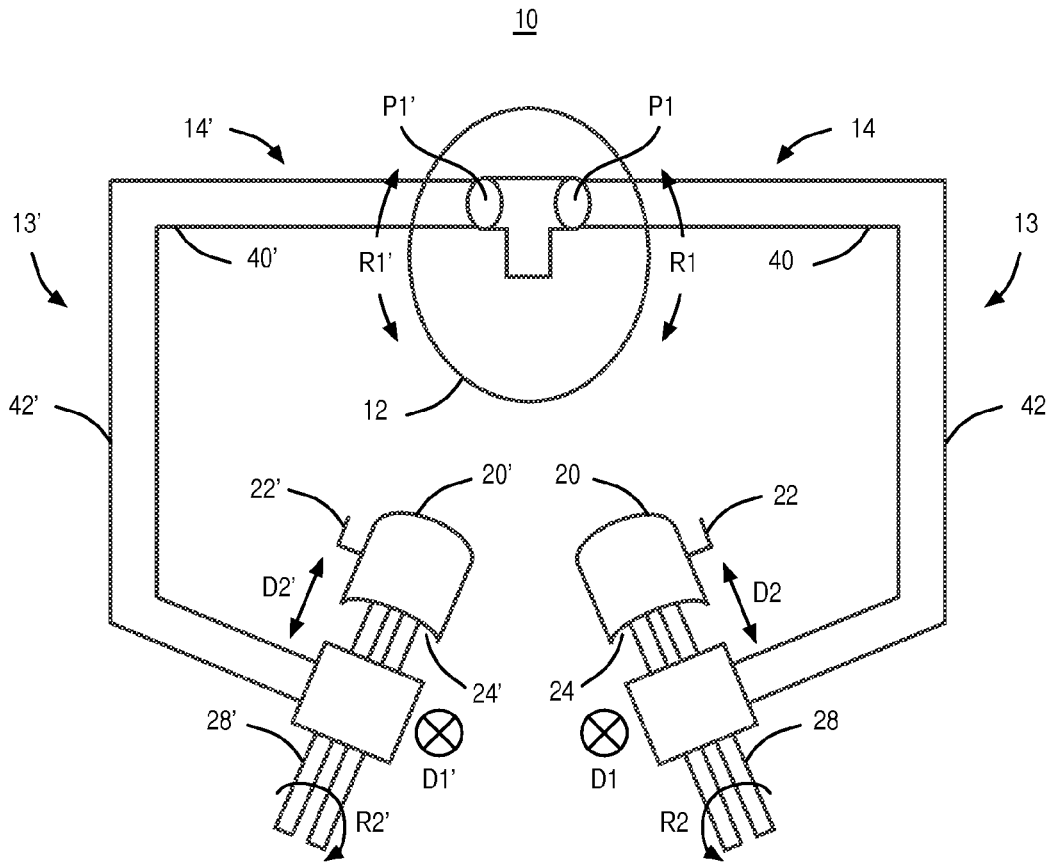
FIG. 1 is an overhead view of an exercise device in an exercise position according to one or more embodiments.
Figure 2:
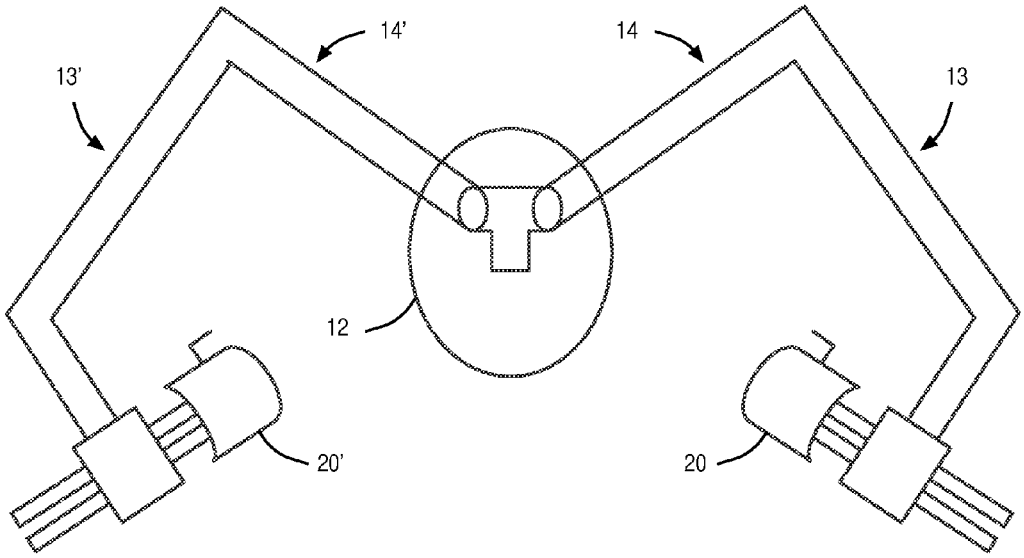
FIG. 2 is an overhead view of an exercise device in an exercise position according to one or more embodiments.
Figure 3:
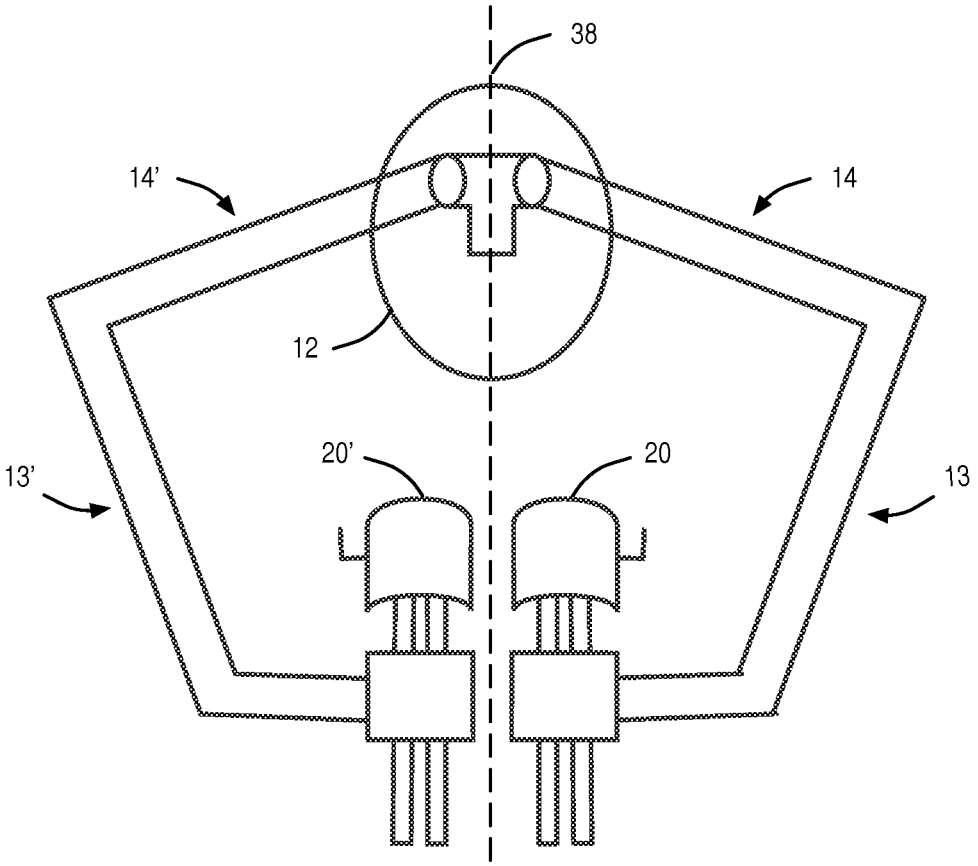
FIG. 3 is an overhead view of an exercise device in an exercise position according to one or more embodiments.

The exercise device disclosed herein advantageously provides for adjustment of the exercise mechanisms, notably the resistance wheel in a variety of positions. For example, the first support member 14 is rotatable about pivot a pivot in the R1 direction. This allows each of the support members 14, 14' to rotate as shown in the overhead views of FIG. 1, FIG. 2, and FIG. 3, where each position represents a distinct method of exercise where the resistance wheel 20 is positioned variably relative to the seat 12. This allows for symmetrical placement of the support members 14, 14' relative to the seat 12, but also allows for asymmetrical placement of the support members 14, 14' relative to the seat 12 when desired. As illustrated in FIG. 3, there is provided an orientation where both of the resistance wheels 20, 20' are equidistant from a centerline and generally parallel with one another. The upright portion 44 is extendable about D1. Similarly, sliders 28 are adjustable along path D2 and rotatable about R2. Similarly, each related element is rotatable, pivotable, extendable, or adjustable about the corresponding exercise assembly 13' and associated elements. As illustrated the resistance wheels 20, 20' always point towards the shoulders of the user in one or more embodiments.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. An exercise device comprising:

a seat;

a first exercise assembly that includes:

a first support member pivoting from a first pivot point about the seat;

a first resistance wheel having a first handle extending therefrom, the first resistance wheel being attached on a terminal end of a first slider to a first mount carrying the first resistance wheel and having a first plate and second plate through which a first pin extends thereinto in order to rotate the first resistance wheel relative to the first slider, a second exercise assembly that includes:

a second support member pivoting from a second pivot point about the seat;

a second resistance wheel having a second handle extending therefrom, the second resistance wheel being attached on a terminal end of a second slider to a second mount carrying the second resistance wheel and having a first plate and second plate through which a second pin extends thereinto in order to rotate the second resistance wheel relative to the second slider, wherein each the first support member and the second support member are pivotable from the respective first and second pivot points in order to place the respective first and second resistance wheels in a plurality of discrete positions relative to the seat including one position in which the first resistance wheel is locked in position and spaced-apart and extending parallel to a longitudinally extending centerline of the seat and the second resistance wheel is locked in position and spaced-apart and extending parallel to the longitudinally extending centerline such that the first resistance wheel and the second resistance wheel are spaced-apart and extend parallel to one another.

2. The device of claim 1, wherein the first support member defines first and second portions that are angled relative to one another.

3. The device of claim 2, wherein the first support member defines an upright portion extending from the second portion.

4. The device of claim 1, wherein the first handle extends offset from a centerline of the first resistance wheel and the second handle extends offset from a centerline of the second resistance wheel.

5. The device of claim 1, wherein the first slider is configured to translate the first resistance wheel relative to the first support member.

6. The device of claim 1, wherein the first slider has a compression pin extending between two spaced-apart cassettes, wherein the compression pin locks the first slider relative to the first support.

7. The device of claim 3, wherein the first slider is carried by the upright portion of the first support member.

8. The device of claim 3, wherein the upright portion is adjustable lengthwise to adjust a height thereof.

9. The device of claim 1, wherein the first plate of the first exercise assembly is rigidly secured to the first slider and the second plate of the first exercise assembly is rotatably carried by the first slider, and the first plate of the second exercise assembly is rigidly secured to the second slider and the second plate of the second exercise assembly is rotatably carried by the second slider.

10. The device of claim 1, wherein the second plate of the first exercise assembly has a plurality of circumferentially defined apertures defined therethough to which the first pin extends to lock the first resistance wheel in a desired position relative to the first slider, and the second plate of the second exercise assembly has a plurality of circumferentially defined apertures defined therethough to which the second pin extends to lock the second resistance wheel in a desired position relative to the second slider.

11. The device of claim 3, further including a weight support biasing member extending from the upright portion to the first mount of the first slider for biasing lifting of the first mount to a desired height position.

12. An exercise device comprising:

a seat;

a first exercise assembly that includes:

a first support member pivoting from a first pivot point (R1) about the seat;

a first resistance wheel having a first handle extending therefrom, the first resistance wheel being attached on a terminal end of a first slider to a first mount carrying the first resistance wheel and having a first plate and second plate through which a first pin extends thereinto in order to rotate the first resistance wheel relative to the first slider about a second pivot point (R2), wherein the first resistance wheel is slidable along a first path (D2) to vary a distance of the first resistance wheel from the seat, the first support member being adjustable heightwise along a second path (D1), a second exercise assembly that includes:

a second support member pivoting from a third pivot point (R1') about the seat;

a second resistance wheel having a second handle extending therefrom, the second resistance wheel being attached on a terminal end of a second slider to a second mount carrying the second resistance wheel and having a first plate and second plate through which a second pin extends thereinto in order to rotate the second resistance wheel relative to the second slider about a fourth pivot point (R2'), wherein the second resistance wheel is slidable along a third path (D2') to vary a distance of the second resistance wheel from the seat, the second support member being adjustable heightwise along fourth path (D1'), wherein each the first support member and the second support member are pivotable from the respective first and third pivot points in order to place the respective first and second resistance wheels in a plurality of discrete positions relative to the seat including one position in which the first resistance wheel is locked in position and spaced-apart and extending parallel to a longitudinally extending centerline of the seat and the second resistance wheel is locked in position and spaced-apart and extending parallel to the longitudinally extending centerline such that the first resistance wheel and the second resistance wheel are spaced-apart and extend parallel to one another.

13. The device of claim 12, wherein the first support member defines first and second portions that are angled relative to one another.

14. The device of claim 13, wherein the first support member defines an upright portion extending from the second portion.

15. The device of claim 12, wherein the first handle extends offset from a centerline of the first resistance wheel and the second handle extends offset from a centerline of the second resistance wheel.

16. The device of claim 12, wherein the first slider has a compression pin extending between two spaced-apart cassettes, wherein the compression pin locks the first slider relative to the first support.

17. The device of claim 14, wherein the first slider is carried by the upright portion of the first support member.

18. The device of claim 14, wherein the upright portion is adjustable lengthwise to adjust a height thereof.

19. The device of claim 14, further including a weight support biasing member extending from the upright portion to the first mount of the first slider for biasing lifting of the first mount to a desired height position.

* * * * *